US006389758B1

(12) United States Patent
Martin, Jr.

(10) Patent No.: US 6,389,758 B1
(45) Date of Patent: May 21, 2002

(54) INSULATED FORM ASSEMBLY FOR POURED CONCRETE WALL

(76) Inventor: Robert Martin, Jr., 1305 Rochester Rd., Oakland Township, MI (US) 48363

( * ) Notice: Subject to any disclaimer, the term of this patent is extended or adjusted under 35 U.S.C. 154(b) by 0 days.

(21) Appl. No.: 09/108,741

(22) Filed: Jul. 1, 1998

(51) Int. Cl.[7] ..... E04C 1/00; E04C 2/00
(52) U.S. Cl. ..... 52/125.2; 52/223.7; 52/439
(58) Field of Search ..... 52/439, 745.09, 52/745.1, 745.12, 223.7, 223.9, 125.2

(56) References Cited

U.S. PATENT DOCUMENTS 2,781,657 A * 2/1957 Taylor ..... 52/223.7
3,378,969 A * 4/1968 Larger ..... 52/223.7
3,430,397 A * 3/1969 Ellis ..... 52/223.7
4,001,988 A * 1/1977 Reifler ..... 52/223.7
4,757,656 A * 7/1988 Powers, Jr. ..... 52/223.9
5,014,480 A 5/1991 Guarriello et al.
5,123,222 A 6/1992 Guarriello et al.

* cited by examiner

*Primary Examiner*—Michael Safavi
(74) *Attorney, Agent, or Firm*—Bliss McGlynn & Nolan, P.C.

(57) ABSTRACT

An insulated form assembly for a poured concrete wall includes a plurality of insulated forms. The wall is constructed from the insulated forms. The wall includes a cap fittingly retained on opposed edges of the forms and a band circumscribing the forms and the caps to pre-assemble the assembly. Each form assembly being made by connecting upper and lower ends of a plurality of interlocking form panels with the band circumscribing the resulting assembly to hold the form panels together. Ends of the circumscribing band being fashioned into a loop so as to form a handle.

1 Claim, 1 Drawing Sheet

INSULATED FORM ASSEMBLY FOR POURED CONCRETE WALL

BACKGROUND OF THE INVENTION

1. Field of the Invention

The present invention relates generally to poured concrete walls and, more particularly, to an insulated form assembly for a poured concrete wall.

2. Description of the Related Art

Conventional concrete wall construction is well known in the art of building a structure. For example, in a house, basement walls may be constructed of poured concrete. To build a poured concrete wall, a temporary form is prepared in the desired shape of the wall. In the past, the form was made from plywood or metal. Recently, the forms have been made from other materials, including foamed plastic. The form is usually constructed at the site of the structure.

The form is maintained in an upright position during the construction process using extensive bracing. For example, 2×4 studs may be used as braces. After the form is in prepared, concrete is poured into the form and allowed to harden. The form is then removed from the hardened concrete wall.

Another example of a wall for a structure is an insulated concrete wall. In an insulated concrete wall, the wall is made from a combination of an insulating material and concrete. The insulating material is a permanent form, which becomes an integral part of the wall. Usually, the form is made from an insulating material, such as a dense plastic foam. The wall may be constructed from a plurality of plastic forms at the construction site. Similar to a poured concrete wall, extensive bracing is used to maintain the wall in the desired position. The resulting insulated concrete wall has the strength of a poured concrete wall with the additional advantage of thermal and acoustical insulation, an air and vapor barrier, and exterior wall sheathing. The disadvantage of such an insulating concrete wall is that it requires a significant period of time to build the wall, and extensive bracing to maintain the upright position of the wall, until the concrete has hardened. Therefore, there is a need in the art for an insulated form assembly for a poured concrete wall that can be preassembled, and held in position until the concrete hardens, with minimal bracing.

SUMMARY OF THE INVENTION

It is, therefore, one object of the present invention to provide a new and improved insulated form assembly for a poured concrete wall.

It is another object of the present invention to provide an insulated form assembly for a poured concrete wall that can be preassembled.

It is yet another object of the present invention to provide an insulated form assembly for a poured concrete wall that requires minimal bracing.

To achieve the foregoing objects, the present invention is an insulated form assembly for a poured concrete wall. The insulated form assembly includes a plurality of insulated forms, a cap fittingly retained on opposed edges of the insulated forms and a band circumscribing the insulated forms and the caps to pre-assemble the assembly.

One advantage of the present invention is that an insulated form assembly is provided for constructing an insulated poured concrete wall that offers improved strength, thermal and acoustical insulation and an air and vapor barrier. Another advantage of the present invention is that the insulated form assembly can be preassembled off-site, transported to the construction site, and put into place for the desired structure with minimal manpower and equipment. Still another object of the present invention is that the use of a removable bracket minimizes the amount of bracing necessary to hold the wall upright before the concrete is poured into the form.

Other objects, features and advantages of the present invention will be readily appreciated as the same becomes better understood after reading the subsequent description when considered in connection with the accompanying drawings.

DESCRIPTION OF THE PREFERRED EMBODIMENT(S)

Figure 1:
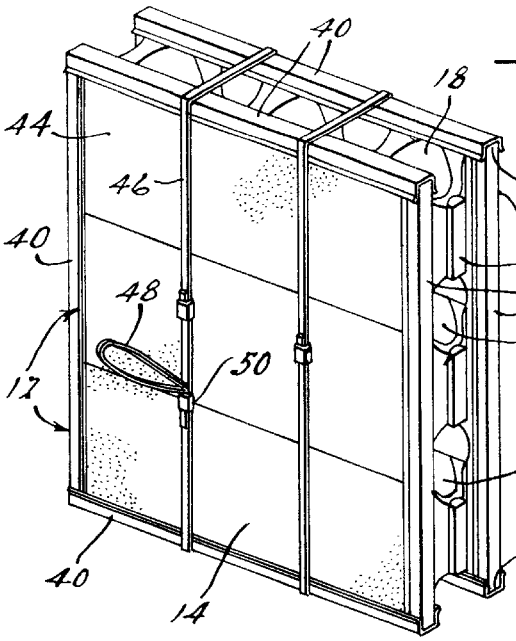
FIG. 1 is a perspective view of an insulated form assembly, according to the present invention, for a poured concrete wall.
Figure 2:
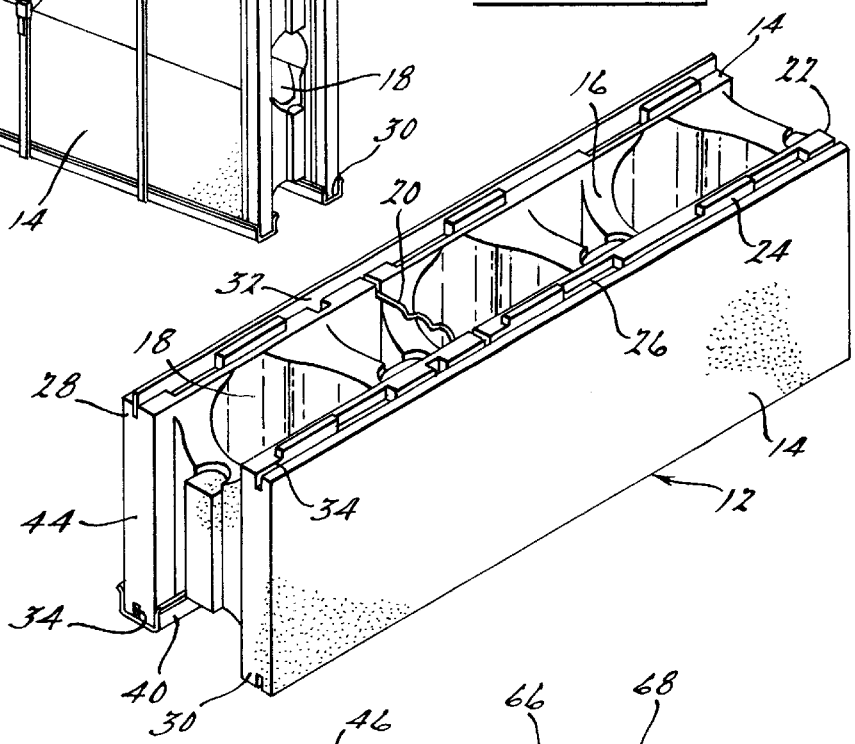
FIG. 2 is an elevational view of a plastic foam form, according to the present invention, of the insulated form assembly of FIG. 1.

Referring to FIGS. 1 and 2, one embodiment of an insulated form assembly 10, according to the present invention, is illustrated for a poured concrete wall. The insulated form assembly 10 includes a plurality of interconnected forms generally indicated at 12. Each form 12 includes two generally planer opposing panels 14. Each form 12 also includes a plurality of interior segments 16 interconnecting the panels 14 and forming a plurality of channels 18 which are later filled with poured concrete in a manner to be described. The panels 14 and segments 16 are made of an insulated foam material such as Styrofoam. It should be appreciated that the panels 14 and segments 16 are integral, unitary, continuous and formed as one-piece.

Each form 12 includes a supporting member 20 positioned within the channel 18 to provide additional structural strength to the finished insulated poured concrete wall. In this example, each panel 14 is approximately 30" long, 12" wide, and 2" deep. Similarly, each individual form 12 is approximately 30" long, 12" wide and 10" deep. Preferably, an exterior surface of the panel 14 includes a decorative pattern (not shown), such as to resemble a concrete block.

Each form 12 includes an interlocking portion 22 for fittingly engaging with another form 12 in a manner to be described. In one embodiment, the interlocking portion 22 is a longitudinally extending pair of alternating projecting members 24 and recessed members 26 positioned on either one of an upper edge 28 or a lower edge 30 of the panel 14.

Each form 12 further includes an attaching strip 32 held in a recessed portion 34 in either one of the upper edge 28 or lower edge 30 of the panel 14. Preferably, the attaching strip 32 is made of a metal material and has a generally rectangular shape. The attaching strip 32 may include a longitudinally extending rib (not shown) for reinforcement. One longitudinally extending edge of the attaching strip 32 fits within the recessed portion 34 of one form 12, and the other longitudinally extending edge of the attaching strip 32 fits within the recessed portion 34 of another form 12. The attaching strip 32 provides a rigid surface for retaining a fastener (not shown). For example, in finishing the interior of the structure, drywall (not shown but known in the art)

may be attached, such as by a screw (not shown), directly to the attaching strip 32 portion of the wall. In another example, studs may be attached to the wall, such as in framing an interior wall.

The insulated form assembly 10 also includes a cap 40 having a general "U" shape placed over the lower edge 30 of the panel 14 for the form 12. Preferably, the cap 40 is made from a material such as steel, although another type of rigid material such as plastic could be used. In constructing the insulated form assembly 10, one longitudinally extending edge of the attaching strip 32 is placed in the recessed portion 34 of the upper edge 28. Another form 12 is interconnected to the first form 12, such that the interlocking portion 22 of each form 12 is aligned and locked and the attaching strip 32 fits within the corresponding recessed portion 34. It should be appreciated that the interconnecting forms 12 are added until the desired height is attained.

The length and/or height of the insulated form assembly 10 can be extended by connecting form assemblies 10 into each other. Preferably, the cap 40 is placed over a laterally extending side edge 44 of the panel 14 on each form 12. Each form assembly 10 maybe glued together, such as with a foamed glue. The cap 40 may also be overlapped across two form assemblies 10 and fastened down, such as with a screw (not shown).

The insulated form assembly 10 also includes at least one band or strip 46 circumscribing or connecting the forms 12 and caps 40 for pre-assembling the insulated form assembly 10 together during shipping, handling and installation at the construction site. Preferably, the band 46 is made of a metal material, although it could be of another rigid material such as a plastic. It should be appreciated that the ends 48 of the band 46 may be secured by a retaining mechanism 50, such as a clip, as is known in the art. One end 48 may be looped prior to inserting onto the retaining mechanism 50 to form a handle. Advantageously, the insulated form assembly 10 is lightweight for ease of transportability and maneuverability.

Figure 3:
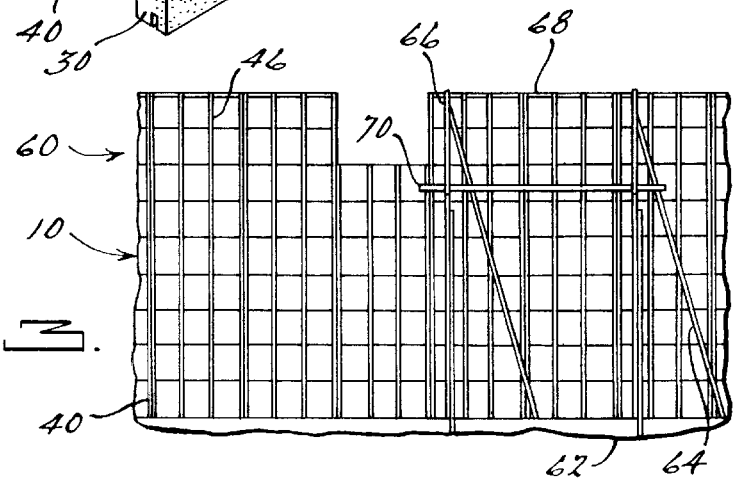
FIG. 3 is an elevational view of the installed form assembly, installed at a construction site.

Referring to FIG. 3, an insulated form assembly 60 for a poured concrete wall is illustrated. It should be appreciated that, in this example, the insulated form assembly 60 is representative of a basement wall for a house, although other types of wall structures are contemplated. To install the insulated form assembly 60, a building site 62 is excavated, as is known in the art. Footings (not shown) for supporting the structure are installed in the shape of the structure. For example, the footings may be of concrete block. A pre-assembled insulated form assembly 10 is then placed in the desired position. Individual pre-assembled insulated form assemblies 10 may then be secured together as previously described. Each insulated form assembly 10 is braced with braces 64. As is known is the art, studs may be used as braces 64. Preferably, a hanger 66 as known in the art, may be secured over the uppermost edge 68 of the form assembly 60. The hangers 66 may be spaced an appropriate distance apart. The hanger 66 is capable of supporting a plank 70 positioned on a vertical surface of the hanger 66 to form a catwalk. The catwalk provides accessability to pour concrete into the form assembly 60.

After the installed insulated form assembly 60 is in place, and braced, concrete is poured into the form assembly 60. A worker (not shown) can walk along the plank 70 while directing the pouring of the uncured concrete cement. The concrete cement flows through and fills each channel 18 within the insulated form assembly 10. After the concrete cures or hardens, the banding 46 and bracing 64 may be removed to complete the insulated poured concrete wall.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. An insulated form assembly for a poured concrete wall comprising:

a plurality of interlocking forms, each of said interlocking forms comprising two generally planar opposing panels interconnected by a plurality of interior segments defining a plurality of channels for receiving cement, an interlocking portion for fittingly engaging another one of said forms, and a recessed portion for holding an attaching strip, and each of said interlocking forms being made from a foam material;

a first cap fittingly retained on a lower edge of said interlocking forms;

a second cap fittingly retained on an upper edge of said interlocking forms;

a band circumscribing said first cap and said second cap and said interlocking forms; and a loop on an end of said band and a retaining mechanism securing ends of said band.

* * * * *

UNITED STATES PATENT AND TRADEMARK OFFICE

CERTIFICATE OF CORRECTION

PATENT NO. : 6,389,758 B1
DATED : May 21, 2002
INVENTOR(S) : Martin

It is certified that error appears in the above-identified patent and that said Letters Patent is hereby corrected as shown below:

Title page,
Item [*] Notice, delete "0" and insert -- 89 --.

Signed and Sealed this

Thirtieth Day of August, 2005

JON W. DUDAS
*Director of the United States Patent and Trademark Office*